US010278886B2

(12) United States Patent
Fong

(10) Patent No.: US 10,278,886 B2
(45) Date of Patent: May 7, 2019

(54) CRUTCH GRIP, CRUTCH GRIP ASSEMBLY, AND CORRESPONDING METHODS

(71) Applicant: Medline Industries, Inc., Mundelein, IL (US)

(72) Inventor: Brendan Fong, Riverwoods, IL (US)

(73) Assignee: Medline Industries, Inc., Northfield, IL (US)

( * ) Notice: Subject to any disclaimer, the term of this patent is extended or adjusted under 35 U.S.C. 154(b) by 471 days.

(21) Appl. No.: 14/522,438

(22) Filed: Oct. 23, 2014

(65) Prior Publication Data

US 2016/0113832 A1 Apr. 28, 2016

(51) Int. Cl.
*A61H 3/02* (2006.01)

(52) U.S. Cl.
CPC ..... *A61H 3/02* (2013.01); *A61H 2201/0192* (2013.01); *A61H 2201/1635* (2013.01)

(58) Field of Classification Search
CPC ..... A61H 3/02; A61H 2201/0192; Y10T 16/469; Y10T 16/476; Y10S 16/24; Y10S 16/25
USPC ..... 135/72
See application file for complete search history.

(56) References Cited

U.S. PATENT DOCUMENTS 596,203 A * 12/1897 Drake ..... A61H 3/02 135/69
D31,802 S 11/1899 Gardner et al.
705,741 A * 7/1902 Drew ..... A61H 3/02 135/69
1,296,042 A * 3/1919 Bralove ..... F16B 7/00 403/379.2
2,239,180 A * 4/1941 Kupfer ..... A61H 3/02 135/72
2,669,244 A * 2/1954 Greene ..... A61H 3/02 135/72
2,793,647 A * 5/1957 Urie ..... A61H 3/02 135/69
3,195,550 A 7/1965 Ingalls
3,269,399 A * 8/1966 Smith ..... A61H 3/02 135/72
4,572,227 A 2/1986 Wheeler
4,647,241 A 3/1987 Weber
D304,904 S 12/1989 Kercher
5,101,845 A 4/1992 Kravetz
(Continued)

OTHER PUBLICATIONS

Czyz, Steven "NonFinal OA", U.S. Appl. No. 29/507,103, filed Oct. 23, 2014; dated Nov. 10, 2015.
(Continued)

*Primary Examiner* — Jeffrey O'Brien
(74) *Attorney, Agent, or Firm* — Philip H. Burrus, IV

(57) ABSTRACT

A crutch grip (100) includes a grip (101) disposed between a first grip end (102) and a second grip end (103). The first grip end and the second grip end can define a partially annular receiver for a crutch post (106,107). One or more retaining clips (108,109) can include a base member (408, 409), a first, curved, cantilevered leg (410,411), and a second, curved, cantilevered leg (412,413). The retaining clips can removably engage an outer surface (202,203) of the first grip end or the second grip end such that an annular clasp (602,603) is defined between the first grip end or the second grip end and the retaining clips.

20 Claims, 9 Drawing Sheets

(56) References Cited

U.S. PATENT DOCUMENTS

| | | | | | |
|---|---|---|---|---|---|
| 5,197,502 | A * | 3/1993 | Wang | A61H 3/02 | 135/68 |
| 5,291,910 | A * | 3/1994 | Bui | A61H 3/02 | 135/68 |
| 5,299,589 | A * | 4/1994 | Zatulovsky | A61H 3/02 | 135/68 |
| 5,341,829 | A * | 8/1994 | Hsiao | A61H 3/02 | 135/68 |
| 5,381,813 | A | 1/1995 | Miric et al. | | |
| 5,605,170 | A * | 2/1997 | Weng | A61H 3/02 | 135/68 |
| 5,606,985 | A * | 3/1997 | Battiston | A61H 3/02 | 135/72 |
| 5,765,583 | A * | 6/1998 | Gamper | A61H 3/02 | 135/65 |
| 5,791,360 | A | 8/1998 | Battiston et al. | | |
| D409,479 | S | 5/1999 | Beugelsdyk | | |
| D423,994 | S | 5/2000 | Helwig | | |
| D425,293 | S | 5/2000 | Maalik | | |
| D425,784 | S * | 5/2000 | Beugelsdyk | D8/395 | |
| 6,079,431 | A * | 6/2000 | Su | A61H 3/02 | 135/68 |
| 6,314,977 | B1 * | 11/2001 | Obitts | A61H 3/02 | 135/68 |
| D457,414 | S | 5/2002 | Spångmyr | | |
| 6,704,968 | B2 * | 3/2004 | Lau | A01B 1/026 | 16/426 |
| 6,802,326 | B2 | 10/2004 | Kusama | | |
| D521,720 | S | 5/2006 | Karasin | | |
| D537,334 | S | 2/2007 | Lee | | |
| 7,255,120 | B2 | 8/2007 | Garza et al. | | |
| D553,971 | S | 10/2007 | Krueger | | |
| 7,434,592 | B2 * | 10/2008 | Larson | A61H 3/02 | 135/72 |
| D595,517 | S | 7/2009 | Fiori | | |
| D617,544 | S | 6/2010 | Okoniewski, Jr. | | |
| D621,680 | S | 8/2010 | Hsu | | |
| D631,403 | S | 1/2011 | Knopf | | |
| 7,882,596 | B2 * | 2/2011 | Hixon | A01B 1/026 | 16/406 |
| 8,069,869 | B1 * | 12/2011 | Huang | A61H 3/02 | 135/68 |
| D659,517 | S | 5/2012 | McGrath | | |
| D672,229 | S | 12/2012 | Reid | | |
| D700,835 | S | 3/2014 | Langlois et al. | | |
| D708,053 | S | 7/2014 | Marini | | |
| 8,800,579 | B2 * | 8/2014 | Severson | A61H 3/02 | 135/72 |
| D712,730 | S | 9/2014 | Gridley | | |
| D720,605 | S | 1/2015 | McGrath | | |
| 9,050,239 | B1 * | 6/2015 | Lin | A61H 3/02 | |
| D739,484 | S | 9/2015 | Kaye | | |
| 2002/0020438 | A1 | 2/2002 | Best | | |
| 2008/0078431 | A1 | 4/2008 | Battiston | | |
| 2008/0092338 | A1 | 4/2008 | Wu | | |
| 2011/0240078 | A1 | 10/2011 | Lenhart et al. | | |

OTHER PUBLICATIONS

"Medline Catalog", Crutch Attachment Platform; Medline Catalog; http://www.medline.com/catalog/catalog.jsp; Unknown Publication date but believed to be prior to present application filing date.

"Medline Catalog", Crutch Foam Hand Grip; Medline Catalog; http://www.medline.com/catalog/catalog.jsp; Unknown Publication date but believed to be prior to present application filing date.

"Medline Catalog", Crutch Grip Accessory Kit; Medline Catalog; http://www.medline.com/catalog/catalog.jsp; Unknown Publication date but believed to be prior to present application filing date.

"Medline Catalog", Crutch Hand Grips (Closed) by Drive/DeVillibiss Health; Medline Catalog; http://www.medline.com/catalog/catalog.jsp; Unknown Publication date but believed to be prior to present application filing date.

"Medline Catalog", Crutch Hand Grips; Medline Catalog; http://www.medline.com/catalog/catalog.jsp; Unknown Publication date but believed to be prior to present application filing date.

"Medline Catalog", Crutch-Mate Arm Pad, Forearm Pad Medline Catalog; http://www.medline.com/catalog/catalog.jsp; Unknown Publication date but believed to be prior to present application filing date.

"Medline Catalog", Deluxe Forearm Crutches by Graham-Field; Medline Catalog; http://www.medline.com/catalog/catalog.jsp; Unknown Publication date but believed to be prior to present application filing date.

"Medline Catalog", Forearm Crutch Cuff; Medline Catalog; http://www.medline.com/catalog/catalog.jsp; Unknown Publication date but believed to be prior to present application filing date.

"Medline Catalog", Guardian/Red-Dot Crutch Hand Grip; Medline Catalog; http://www.medline.com/catalog/catalog.jsp; Unknown Publication date but believed to be prior to present application filing date.

"Medline Catalog", Platform Forearm Crutch by Patterson Med; Medline Catalog; http://www.medline.com/catalog/catalog.jsp; Unknown Publication date but believed to be prior to present application filing date.

"Medline Catalog", Quick-Fit Aluminum Crutches; Medline Catalog; http://www.medline.com/catalog.jsp; Unknown Publication date but believed to be prior to present apllication filing date.

"Medline Catalog", Wooden Crutches by Sammons Preston; Medline Catalog; http://www.medline.com/catalog.jsp; Unknown Publication date but believed to be prior to present apllication filing date.

Czyz, Steven, "Notice of Allowance", U.S. Appl. No. 29/507,103; filed Oct. 23, 2014; dated Mar. 28, 2016.

* cited by examiner

CRUTCH GRIP, CRUTCH GRIP ASSEMBLY, AND CORRESPONDING METHODS

BACKGROUND

Technical Field

This disclosure relates generally to crutches, and more particularly to crutch grips.

Background Art

Patients use crutches for a variety of reasons. For example, when a person sprains an ankle or breaks a leg, they may use crutches to help them remain ambulatory while the injured leg heals. Others use crutches for stability. Some people use two crutches, while others use only a single crutch.

Traditional crutches include an arm support, a pair of vertical posts, and a hand support. The vertical posts extend in a wishbone fashion from the arm support, which rests under the person's underarm, to a bottom post that engages the floor when the crutch is in use. Both the hand support and the arm support are designed to bear some or all of the weight of the user. The height of the handgrip is generally adjustable by removing an elongated screw that passes through the handgrip and both vertical posts. It would be advantageous to have a handgrip that was easier to adjust and manipulate.

Figure 1:
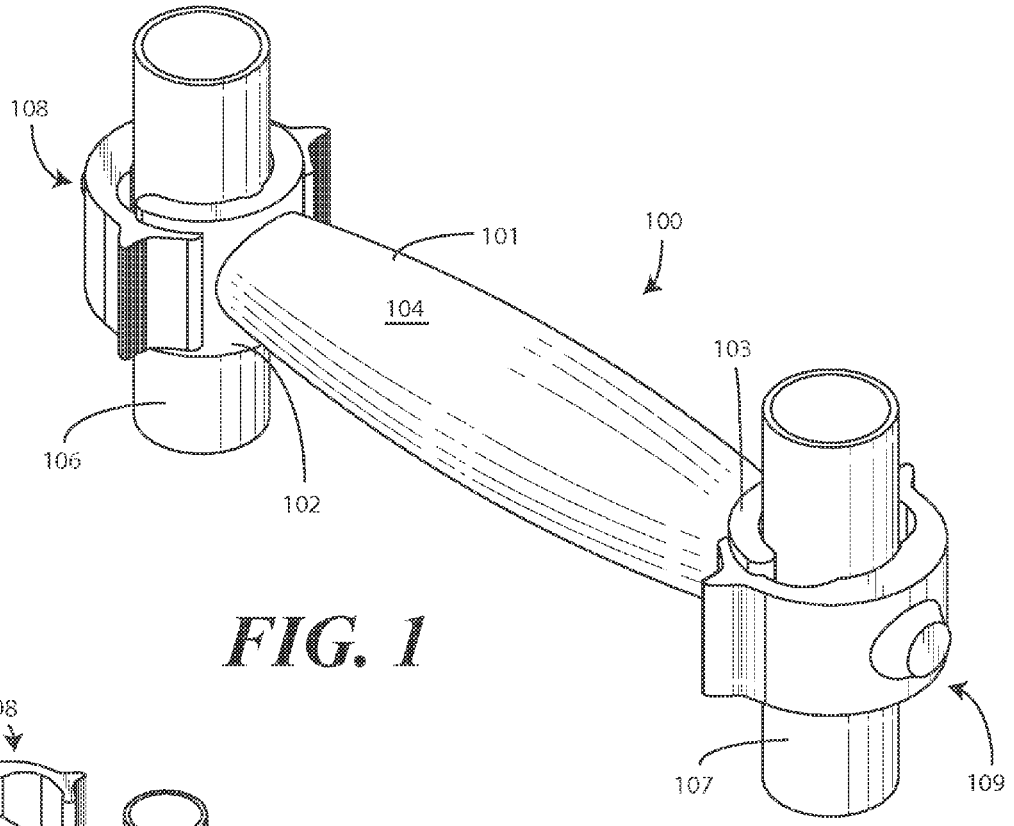
FIG. 1 illustrates one explanatory crutch grip assembly in accordance with one or more embodiments of the disclosure in an engaged configuration.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

DETAILED DESCRIPTION OF THE DRAWINGS

Embodiments of the disclosure are now described in detail. Referring to the drawings, like numbers indicate like parts throughout the views. As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions. Also, reference designators shown herein in parenthesis indicate components shown in a figure other than the one in discussion. For example, talking about a device (10) while discussing figure A would refer to an element, 10, shown in figure other than figure A.

Prior art crutch grips, such as those shown in U.S. Pat. No. 8,069,869 to Huang and U.S. Pat. No. 6,314,977 to Obitts et al. include grips that terminate with circular rings that slide about the vertical posts of a crutch. While these grips are adjustable up and down the posts, they are not easily removable from the crutch. The only way to remove these grips is by disassembling the crutch itself to remove the armrest and expose the ends of the crutch posts. This is cumbersome, time consuming, expensive, and, if not done properly, can compromise the reliability of the crutch itself. With these prior art systems, if a crutch grip becomes soiled or damaged, the only way to replace it is to completely take the crutch apart, replace the grip, and then completely reassembly the crutch.

Embodiments of the disclosure provide a crutch grip that can be easily adjusted or replaced without disassembly of the crutch itself. Embodiments of the disclosure allow the grip to be easily and completely removed from the crutch posts, thereby allowing the grip to be replaced without crutch disassembly. In one embodiment, a crutch grip includes a grip that is disposed between a first grip end and a second grip end. Each of the first grip end and the second grip end define a partially annular receiver for a crutch post. In one embodiment, the partially annular receiver is a semicircular receiver that, when the crutch grip is disposed between two crutch posts, only partially encircles each post.

The crutch grip is then retained in place along the crutch posts by one or more retaining clips. In one embodiment, each retaining clip comprise a base member, a first, curved, cantilevered leg extending from a first side of the base member, and a second, curved, cantilevered leg extending from a second side of the base member. In one embodiment one or more retaining clips can removably engage an outer surface of one or more of the first grip end or the second grip end such that an annular clasp is defined between the first grip end or the second grip end and the at least one retaining clip. As used herein, the term "removably engage" or "selectively engage" refers to the fact that the retaining clips can engage the grip ends to retain the grip securely at a location along the crutch posts, but that can also release and be removed from the grip ends in response to user action to allow the crutch grip to be removed from the crutch posts.

In one embodiment, the retaining clips are manufactured from a pliable rubber or pliable thermoplastic to allow the cantilevered arms to deflect about the base member to selectively engage or disengage the grip ends. One example of a material suitable for use in manufacturing the retaining clips is styrene-butadiene rubber. Other materials will be obvious to those of ordinary skill in the art having the benefit of this disclosure. The use of a pliant material also helps to withstand impact when a crutch using a crutch grip configured in accordance with one or more embodiments of the disclosure is accidentally dropped or otherwise receives an impact force. While prior art crutch grips manufactured from hard plastic may crack under such circumstances, the use of a pliant material ensures that reliability will not be compromised as a result of impact forces contacting the retaining clips or the grip itself.

In one or more embodiments, each retaining clip also includes a grip engagement post extending distally from the base member through a central axis and through an opening of the a C-shape defined by the cantilevered arms. The grip engagement post can pass through an aperture in the crutch post and into an aperture in one of the grip ends to securely retain the crutch grip at a desired height along the crutch post. For increased stability, in one embodiment the grip engagement post is manufactured from a different material than the rest of the engagement clip. For example, while the base member and cantilevered arms can be manufactured from a pliant material such as hard rubber or soft thermoplastic, in one embodiment the grip engagement post is manufactured from metal and is insert molded into the retaining clip.

Turning now to FIGS. 1-6, illustrated therein is one explanatory crutch grip 100 in accordance with one or more embodiments of the disclosure. The crutch grip 100 is shown in an engaged or attached configuration in FIGS. 1, 5, and 6. The crutch grip 100 is shown in a disengaged or detached configuration in FIGS. 2-4.

In one embodiment, the crutch grip 100 includes a grip 101 that is disposed between a first grip end 102 and a second grip end 103. The grip 101, first grip end 102, and second grip end 103 can be manufactured as a unitary part in one or more embodiments. For example, in one embodiment the grip 101, first grip end 102, and second grip end 103 are manufactured as a single, unitary part from a rigid thermoplastic material by way of an injection molding process. In another embodiment, the grip 101, first grip end 102, and second grip end 103 can be manufactured as a single, unitary part from another material, such as metal, wood, rubber, acrylic, or other materials.

In other embodiments, the grip 101, first grip end 102, and second grip end 103 can be separable from each other. For example, in one embodiment the first grip end 102 and second grip end 103 are separable from the grip 101 such that different grips can be attached to a first grip end 102 and second grip end 103 pair. Other ways of configuring the grip 101, first grip end 102, and second grip end 103 will be obvious to those of ordinary skill in the art having the benefit of this disclosure.

In one or more embodiments, a covering can be applied to the grip 101. For example, a rubber foam or sponge type coating can be applied to the grip 101 to make it softer and more comfortable for a user. Perspiration absorbing materials, antimicrobial materials, friction increasing materials, or other materials can be applied to the grip 101 as well.

Figure 4:
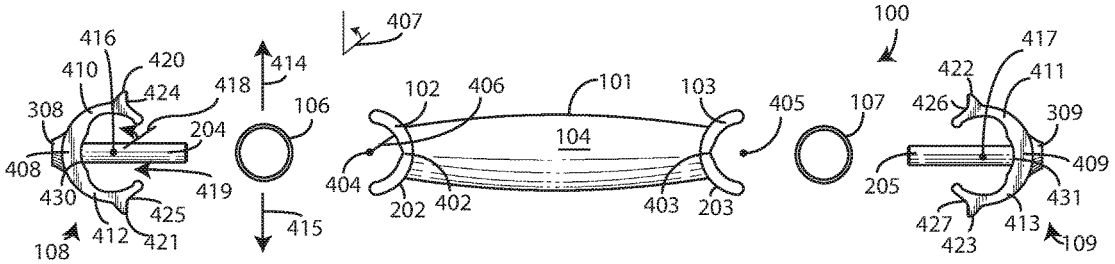
FIG. 4 illustrates one explanatory crutch grip assembly in accordance with one or more embodiments of the disclosure in a disengaged configuration.
Figure 5:
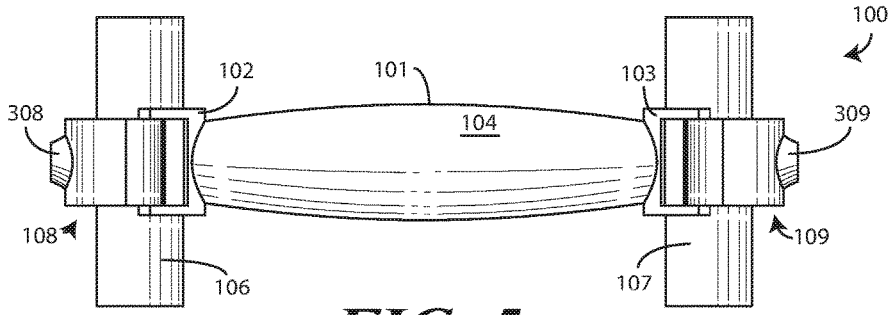
FIG. 5 illustrates one explanatory crutch grip assembly in accordance with one or more embodiments of the disclosure in an engaged configuration.

In one embodiment, the grip 101 has an arcuate outer surface 104. As best shown in FIG. 4, the arcuate outer surface 104 is bow-shaped in one embodiment. In other embodiments, the grip 101 can have a differently shaped surface. For example, finger indentations could be molded into the grip 101. Similarly, shapes and contours could be molded into the grip 101 to accommodate a user's palm, heel of hand, or thumb. Other configurations of the outer surface of the grip 101 will be obvious to those of ordinary skill in the art having the benefit of this disclosure.

In one embodiment, best shown in FIG. 4, each of the grip 101, first grip end 102, and second grip end 103 each define a partially annular receiver 402,403 for a crutch post 106, 107. The partially annular receivers 402,403 are curved, open-ended elements that form a C-shape when viewed in the plan view shown in FIG. 4. In one embodiment, they are curved about an axis 404,405 according to a predefined radius 406 and angle 407. The predefined radius 406 can be selected to accommodate a crutch post 106,107 of a particular diameter. The angle 407 can vary. In one embodiment, the angle 407 is about 180 degrees such that each partially annular receiver 402,403 comprises a semi-circular receiver. In other embodiments, different angles can be used. In one or more embodiments, the angle 407 is less than 180 degrees.

Figure 6:
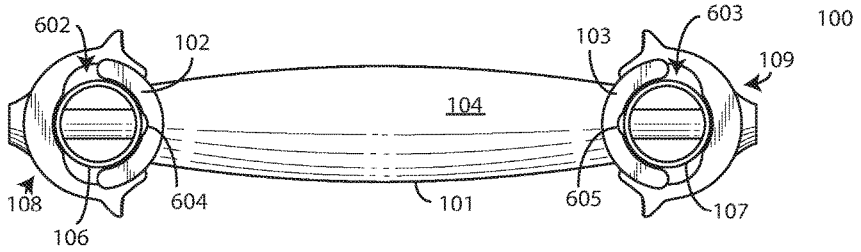
FIG. 6 illustrates one explanatory crutch grip assembly in accordance with one or more embodiments of the disclosure in an engaged configuration.

In one or more embodiments, one or more retaining clips 108,109 retain the crutch grip 100 to the crutch posts 106,107. In the explanatory embodiment of FIGS. 1-6 a first retaining clip 108 and a second retaining clip 109 are included to removably engage an outer surface 202,203 of the first grip end 102 and the second grip end 103, respectively. As best shown in FIG. 6, when the first retaining clip 108 and the second retaining clip 109 engage the outer surface 202 of the first grip end 102 and the outer surface 203 of the second grip end 103, an annular clasp 602,603 is defined between the first grip end 102 and the first retaining clip 108 and the second grip end 103 and the second retaining clip 109, respectively. The crutch posts 106,107 are securely retained in the annular clasps 602,603.

In one embodiment, each retaining clip 108,109 includes a base member 408,409, a first, curved, cantilevered leg 410,411, and a second, curved, cantilevered leg 412,413. In the illustrative embodiment of FIGS. 1-6, the base member 408,409 is curved about a central axis 416,417 so as to define an arched base member. In one embodiment, the first, curved, cantilevered leg 410,411 extends from a first side 414 of the base member 408,409. Similarly, the second, curved, cantilevered leg 412,413 extends from a second side 415 of the base member 408,409.

In one embodiment, the base member 408,409, the first, curved, cantilevered leg 410,411, and the second, curved, cantilevered leg 412,413 are manufactured from a unitary pliant material such that the first, curved, cantilevered leg 410,411 and the second, curved, cantilevered leg 412,413 can selectively deflect outwardly from a central axis 416,417 of the first retaining clip 108 and the second retaining clip 109, respectively. This allows each of the first, curved, cantilevered leg 410,411 and the second, curved, cantilevered leg 412,413 to deflect about the crutch posts 106,107 and then attach to the outer surfaces 202,203 of the first grip end 102 and the second grip end 103.

For example, in one embodiment the base member 408, 409, the first, curved, cantilevered leg 410,411 and the second, curved, cantilevered leg 412,413 are manufactured from a hard rubber material such as styrene-butadiene rubber. Other materials will be obvious to those of ordinary skill in the art having the benefit of this disclosure. For example in another embodiment, the unitary pliant material can be a pliant thermoplastic material. The use of the pliant material serves multiple purposes. As noted above, it allows the first, curved, cantilevered leg 410,411 and the second, curved, cantilevered leg 412,413 to deflect about the crutch posts 106,107 when attaching the retaining clips 108,109 to the first grip end 102 and the second grip end 103. However, the use of a pliant material also helps to withstand impact when a crutch using the crutch grip 100 is accidentally dropped or otherwise receives an impact force. While prior art crutch grips manufactured from hard plastic may crack under such circumstances, the use of a pliant material for the retaining clips 108,109 ensures that reliability will not be compromised as a result of impact forces contacting the retaining clips or the grip itself.

In one embodiment, the base member 408,409, the first, curved, cantilevered leg 410,411 and the second, curved, cantilevered leg 412,413 curve about a central axis 416,417 so as to define a partially closed C-shape. The partially closed C-shape results when the base member 408,409, the first, curved, cantilevered leg 410,411 and the second, curved, cantilevered leg 412,413 span a radial angle 418 of more than 180 degrees such that the opening 419 between the first, curved, cantilevered leg 410,411 and the second, curved, cantilevered leg 412,413 spans a radial angle 418 of less than 180 degrees.

In one embodiment, the first, curved, cantilevered leg 410,411 and the second, curved, cantilevered leg 412,413 each comprise one or more protruding finger grips 420,421, 422,423. A user can grasp the one or more protruding finger grips 421,421,422,423 to deflect the first, curved, cantilevered leg 410,411 and the second, curved, cantilevered leg 412,413 about the base member 408,409 radially away from the central axis 416,417 to selectively release the one or more retaining clips 108,109 from the outer surface 202,203 of the first grip end 102 and the second grip end 103. In one embodiment, the finger grips 420,421,422,423 each define a finger grasping surface 424,425,426,427 is concave relative to the opening 419 of the partially closed C-shape of each retaining clip 108,109. Accordingly, a user can reach from the outside of a crutch post 106,107, grasp the finger grasping surfaces 424,425,426,427, pull against the finger grips 420,421,422,423, and deflect the first, curved, cantilevered leg 410,411 and the second, curved, cantilevered leg 412,413 about the base member 408,409 radially away from the central axis 416,417 to selectively release the one or more retaining clips 108,109 from the outer surface 202,203 of the first grip end 102 and the second grip end 103. Ridged surfaces can be disposed along the finger grasping surfaces 424,425,426,427 to make this action easier.

In one embodiment, each retaining clip 108,109 also includes a grip engagement post 204,205 extending distally from the base member 408,409. In this explanatory embodiment, each grip engagement post 204,205 extends distally from the base member 408,409 through the central axis 416,417 and through the opening 419 of the partially closed-C shape defined by the base member 408,409, the first, curved, cantilevered leg 410,411 and the second, curved, cantilevered leg 412,413 of the retaining clips 108,109.

Figure 2:
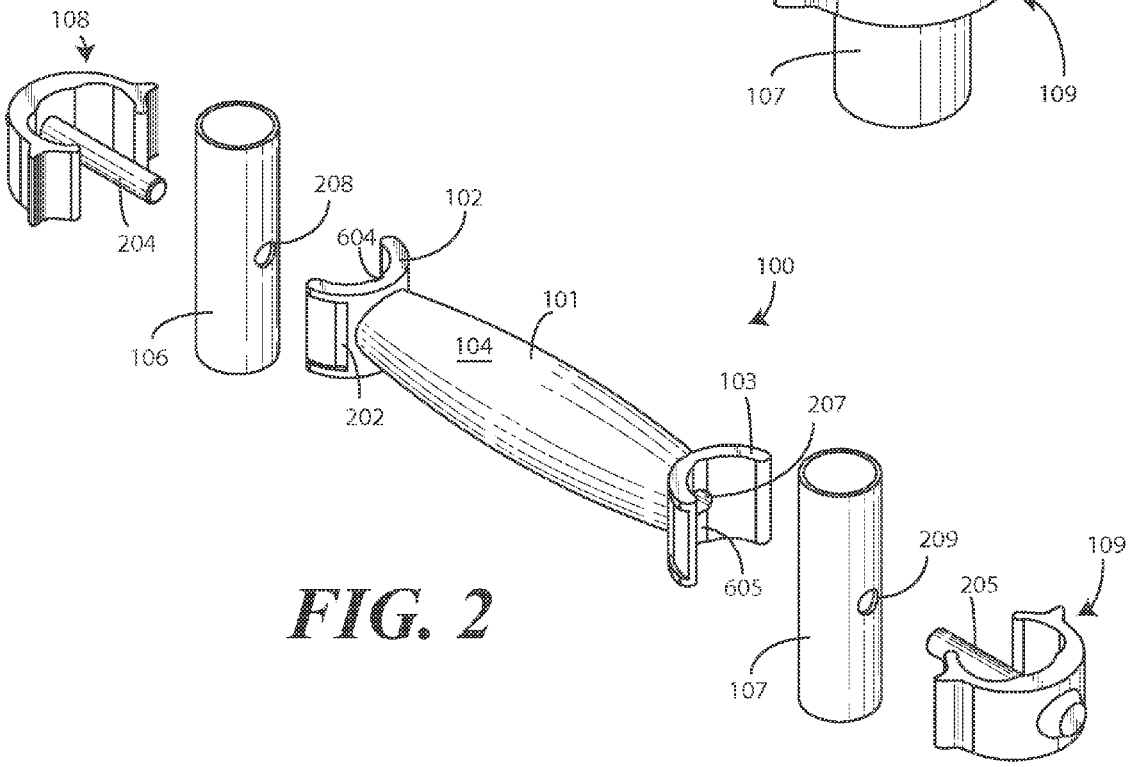
FIG. 2 illustrates one explanatory crutch grip assembly in accordance with one or more embodiments of the disclosure in a disengaged configuration.
Figure 3:
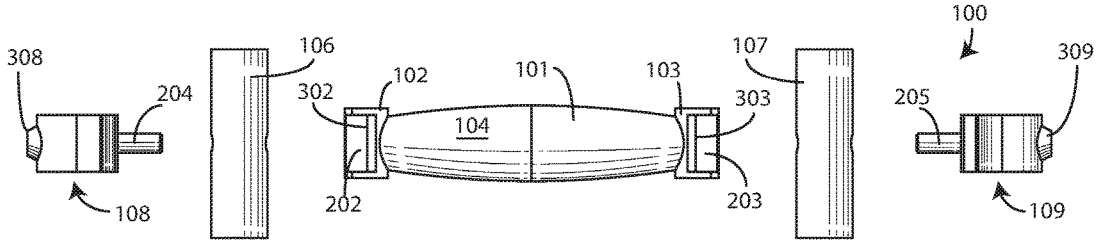
FIG. 3 illustrates one explanatory crutch grip assembly in accordance with one or more embodiments of the disclosure in a disengaged configuration.

As best shown in FIG. 2, in one embodiment each of the first grip end 102 and the second grip end 103 define an aperture 207. The aperture 207 of the second grip end 103 is shown in FIG. 2. However, in one embodiment the first grip end 102 includes an identical aperture. In one embodiment, the apertures 207 in the first grip end 102 and the second grip end 103 are to receive the grip engagement posts 204,205 when the first, curved, cantilevered leg 410,411 and the second, curved, cantilevered leg 412,413 of the retaining clips 108,109 engage the outer surface 202,203 of the first grip end 102 and the second grip end 103, respectively. In one embodiment, the grip engagement posts 204,205 can pass through apertures 208,209 in the crutch posts 106,107 and into the apertures 207 in the first grip end 102 and the second grip end 103 to hold the crutch grip 100 at a static location along the crutch post 106,107.

In one embodiment, the grip engagement posts 204,205 are manufactured from a rigid material such as metal. Where the base member 408,409, the first, curved, cantilevered leg 410,411, and the second, curved, cantilevered leg 412,413 are manufactured from a pliant material, such as styrene-butadiene rubber or a pliant thermoplastic material, the grip engagement posts 204,205 can be insert molded into the styrene-butadiene rubber or pliant thermoplastic material in one embodiment.

In one embodiment, to better align the crutch posts 106,107 between the annular clasp 602,603 defined between the first grip end 102 and the first retaining clip 108 and the second grip end 103 and the second retaining clip 109, respectively, one or more crutch post alignment recesses can be included. As shown in FIGS. 2 and 6, in one embodiment one or both of the first grip end 102 and the second grip end 103 includes a crutch post alignment recess 604,605 into which a portion of a crutch post 106,107 can sit when the grip engagement posts 204,205 when the first, curved, cantilevered leg 410,411 and the second, curved, cantilevered leg 412,413 of the retaining clips 108,109 engage the outer surface 202,203 of the first grip end 102 and the second grip end 103, respectively. In this particular embodiment, the crutch post alignment recesses 604,605 are disposed about the apertures 207 of the first grip end 102 and the second grip end 103.

Similarly, in one embodiment each engagement clip 108, 109 can also include a crutch post alignment recess. As best shown in FIG. 4, in one embodiment the base member 408,409 of each engagement clip 108,109 can also include a crutch post alignment recess 430,431 as well. In this explanatory embodiment, each crutch post alignment recess 430,431 is disposed about a corresponding grip engagement post 204,205.

In one embodiment, each retaining clip 108,109 includes a protrusion 308,309 disposed along an exterior of the partially closed C-shape defined by the base member 408, 409, the first, curved, cantilevered leg 410,411, and the second, curved, cantilevered leg 412,413. In this explanatory embodiment each protrusion 308,309 is disposed along the base member 408,409 opposite the grip engagement post 204,205. While optional, inclusion of the protrusion 308,309 helps to protect the crutch grip 100 when it is accidentally dropped or otherwise receives an impact force. This is especially true when a pliant material is used to manufacture the protrusion 308,309, the base member 408,409, or both.

In one embodiment, to facilitate better retention when the first, curved, cantilevered leg 410,411 and the second, curved, cantilevered leg 412,413 of the retaining clips 108,109 engage the outer surface 202,203 of the first grip end 102 and the second grip end 103, each of the first grip end 102 and the second grip end 103 can include a detent 302,303 disposed along the outer surface 202,203 of the first grip end 102 and the second grip end 103, respectively. In one embodiment, both sides of the first grip end 102 and the second grip end 103 include detents 302,303. The detents 302,303 can define engagement recesses into which the ends of the first, curved, cantilevered leg 410,411 and the second, curved, cantilevered leg 412,413 of the retaining clips 108,109 engage the outer surface 202,203 of the first grip end 102 and the second grip end 103.

In one embodiment, each of the grip 101 and the engagement clips 108,109 can be color-coded. For example, in one embodiment, the base member 408,409, the first, curved, cantilevered leg 410,411, the second, curved, cantilevered leg 412,413, the first grip end 102, the second grip end 103, and the grip 101 all have a common color, such as red or blue. In other embodiments, the grip 101, the first grip end 102, and the second grip end 103 can have a first color, while the base member 408,409, the first, curved, cantilevered leg 410,411, the second, curved, cantilevered leg 412,413 have a different color.

Figure 7:
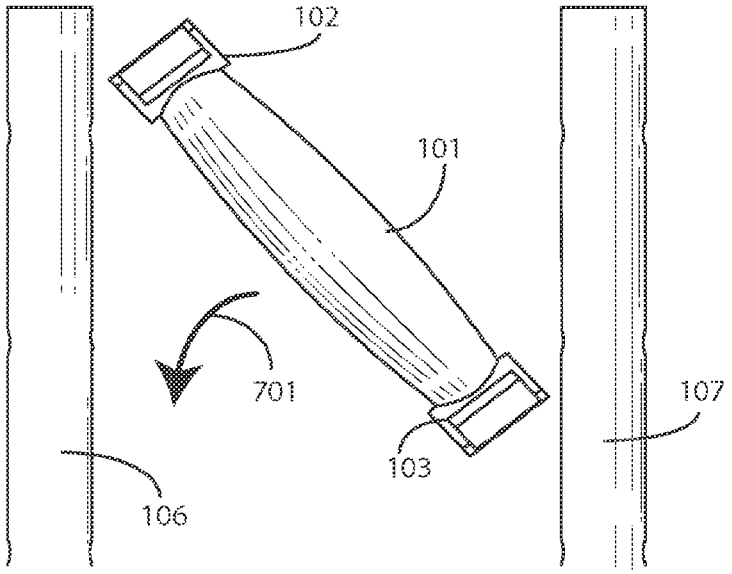
FIG. 7 illustrates one explanatory method step using a crutch grip in accordance with one or more embodiments of the disclosure.
Figure 8:
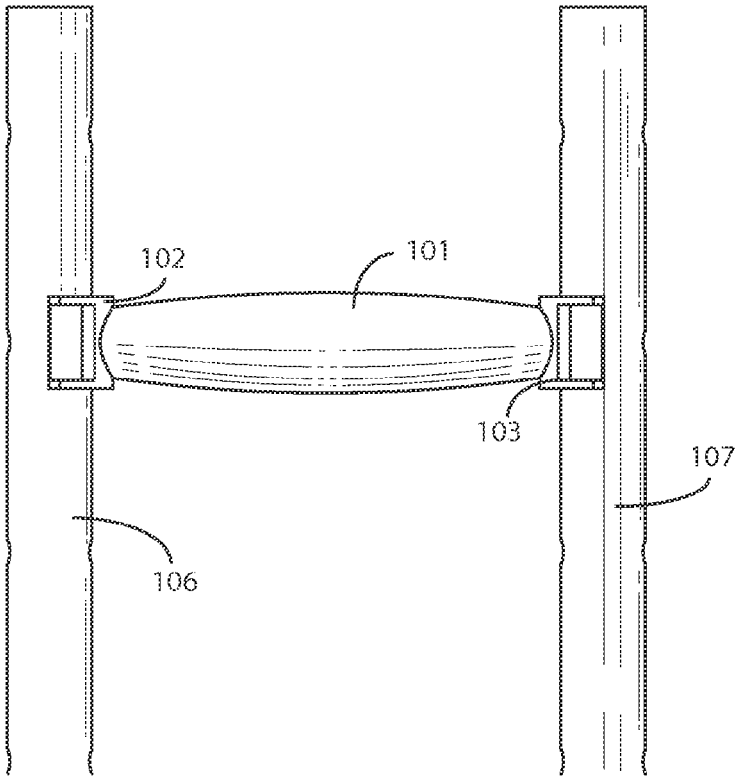
FIG. 8 illustrates another explanatory method step using a crutch grip in accordance with one or more embodiments of the disclosure.
Figure 9:
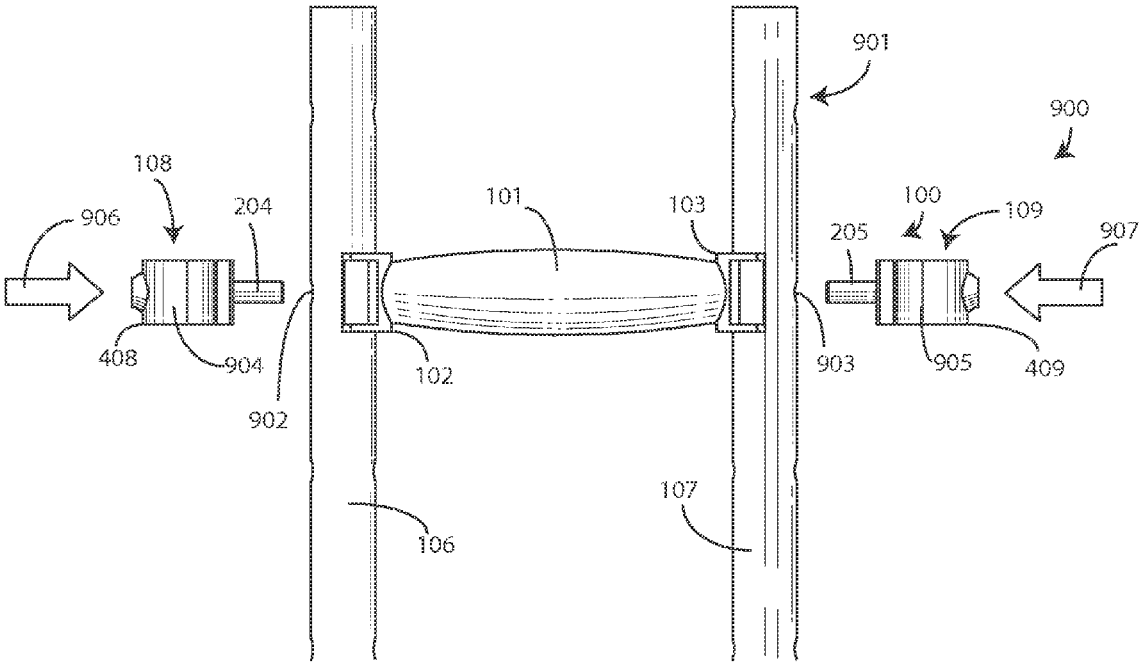
FIG. 9 illustrates yet another explanatory method step using a crutch grip in accordance with one or more embodiments of the disclosure.

Turning now to FIGS. 7-16, illustrated therein are various steps of a method for using a crutch grip assembly 900 configured in accordance with one or more embodiments of the disclosure. As best shown in FIG. 9, in one embodiment the crutch grip assembly 900 comprises a crutch 901 comprising two crutch posts 106,107. Each crutch post 106,107 can include one or more apertures 902,903 defined therein. A crutch grip 100 includes a grip 101 disposed between a first grip end 102 that is partially annular and a second grip end 103 that is partially annular. Two retaining clips 108,109 each comprise a pair of curved cantilevered legs 904,905 extending from a base member 408,409 to define a partially closed C-shape about a central axis as previously described.

Recall from above that with prior art crutch grips include grips that terminate with circular rings that slide about the vertical posts of a crutch. While these grips are adjustable up and down the posts, they are not easily removable from the crutch. The only way to remove these grips is by disassembling the crutch itself to remove the armrest and expose the ends of the crutch posts. This is cumbersome, time consuming, expensive, and, if not done properly, can compromise the reliability of the crutch itself. By contrast, the crutch grip assembly 900 illustrated in FIGS. 7-16 can be easily adjusted or replaced without disassembly of the crutch itself. The grip 101 can be easily and completely removed from the crutch posts 106,107 without removing the armrest.

Turning to FIG. 7, the two crutch posts 106,107 are shown in a default state. A user places the grip 101, which terminates at the first grip end 102 and the second grip end 103, between the crutch posts 106,107 in a diagonal alignment. The user can then twist 701 the grip between the crutch posts 106,107 so that the first grip end 102 and the second grip end 103 engage the crutch posts 106,107. As shown in FIG. 8, the grip 101 is disposed between the two crutch posts 106,107 with the first grip end 102 engaging a first crutch post 105 and a second grip end 103 engaging a second crutch post 106.

Figure 10:
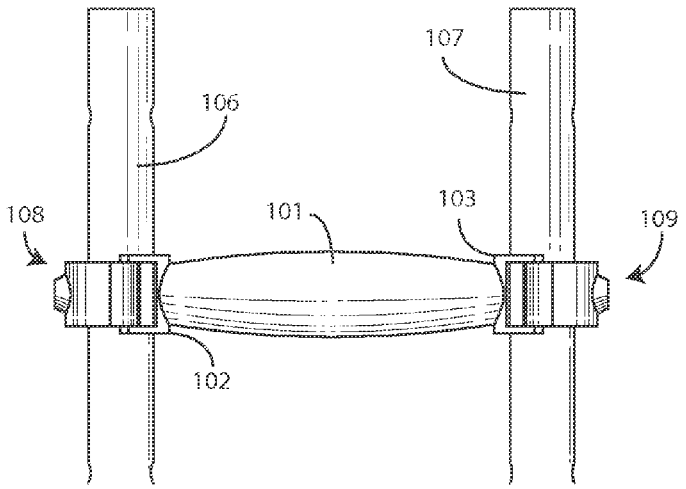
FIG. 10 illustrates another explanatory method step using a crutch grip in accordance with one or more embodiments of the disclosure.

Turning to FIG. 9, the user can then insert 906,907 the retaining clips 108,109 through the apertures 902,903 in the crutch posts 106,107 such that the grip engagement posts 204,205 pass through the apertures 902,903 in the crutch posts 106,107 and engage apertures in the first grip end 102, and the second grip end 103, respectively. When this occurs, as shown in FIG. 10, the retaining clips removably engage an outer surface of the first grip end 102 or the second grip end 103 to retain the first crutch post 106 and the second crutch post 107 between the first grip end 102 and a first retaining clip 108 and a second grip end 103 and a second retaining clip 109, respectively. When this occurs, the grip engagement posts (204,205) passes through the apertures (902,903) in the crutch posts 106,107 and engage the apertures in the grip ends 102,103 to securely retain the grip 101 in a locked configuration along the crutch posts 106, 107.

Figure 11:
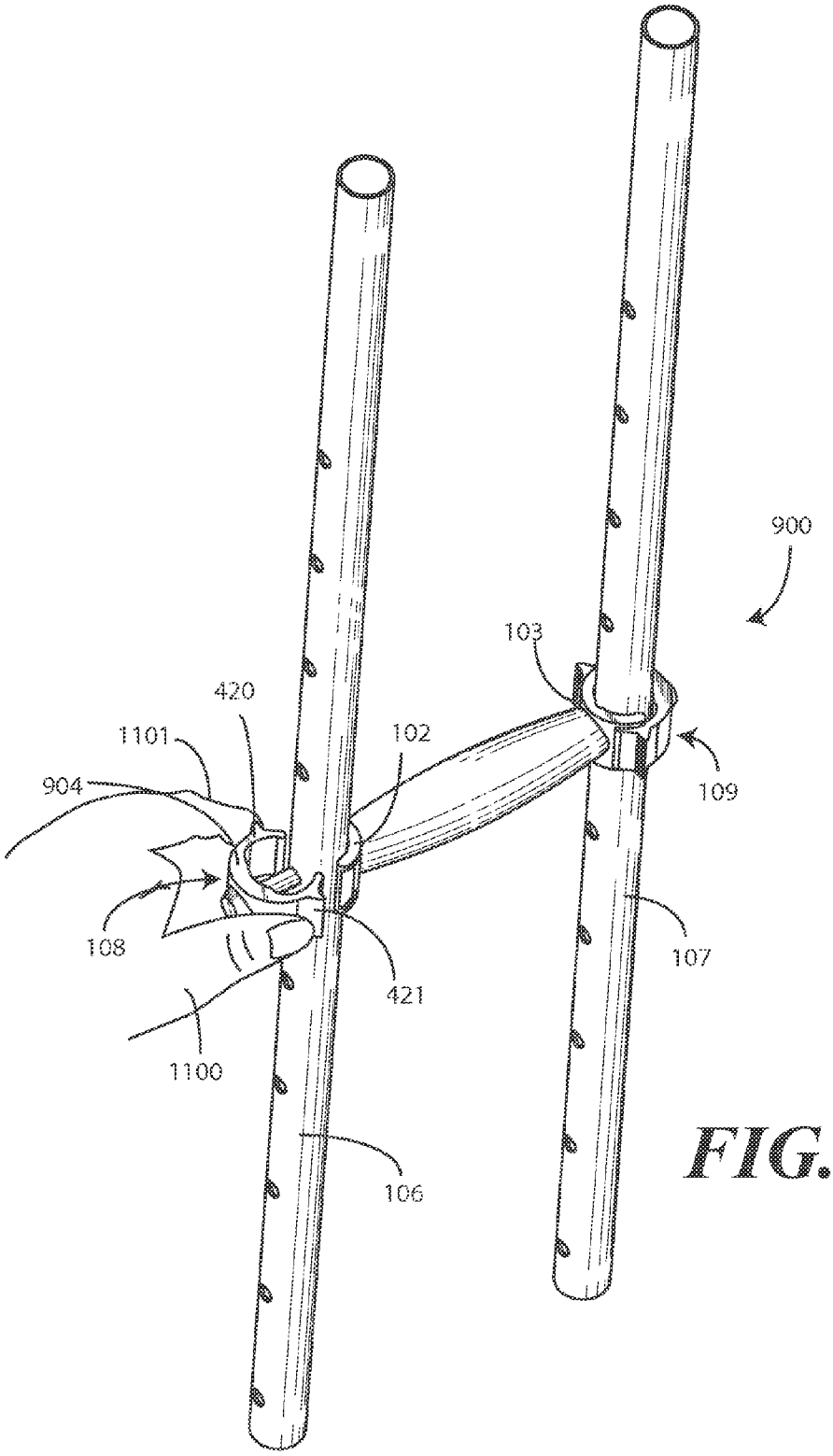
FIG. 11 illustrates another explanatory method step using a crutch grip in accordance with one or more embodiments of the disclosure.
Figure 12:
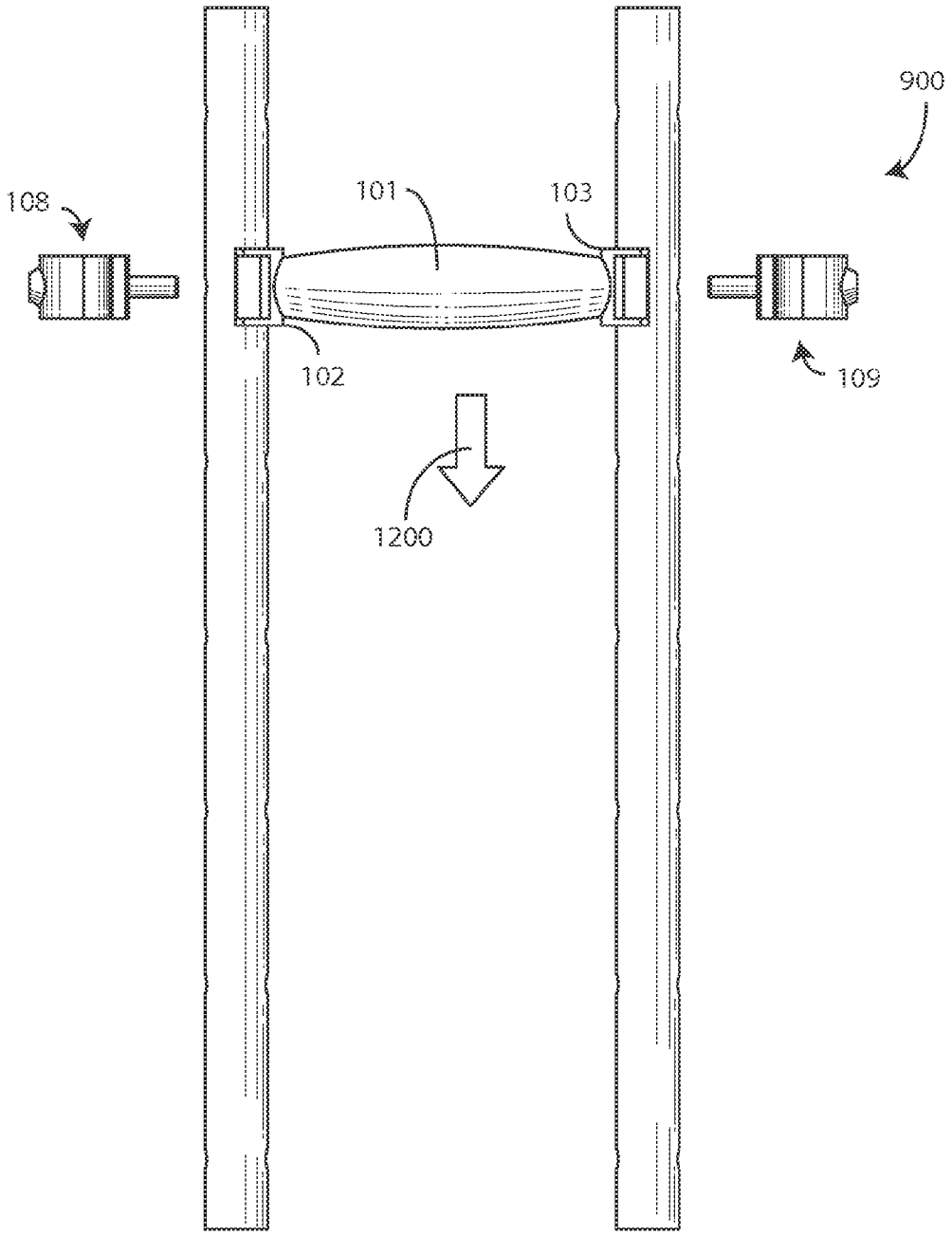
FIG. 12 illustrates another explanatory method step using a crutch grip in accordance with one or more embodiments of the disclosure.
Figure 13:
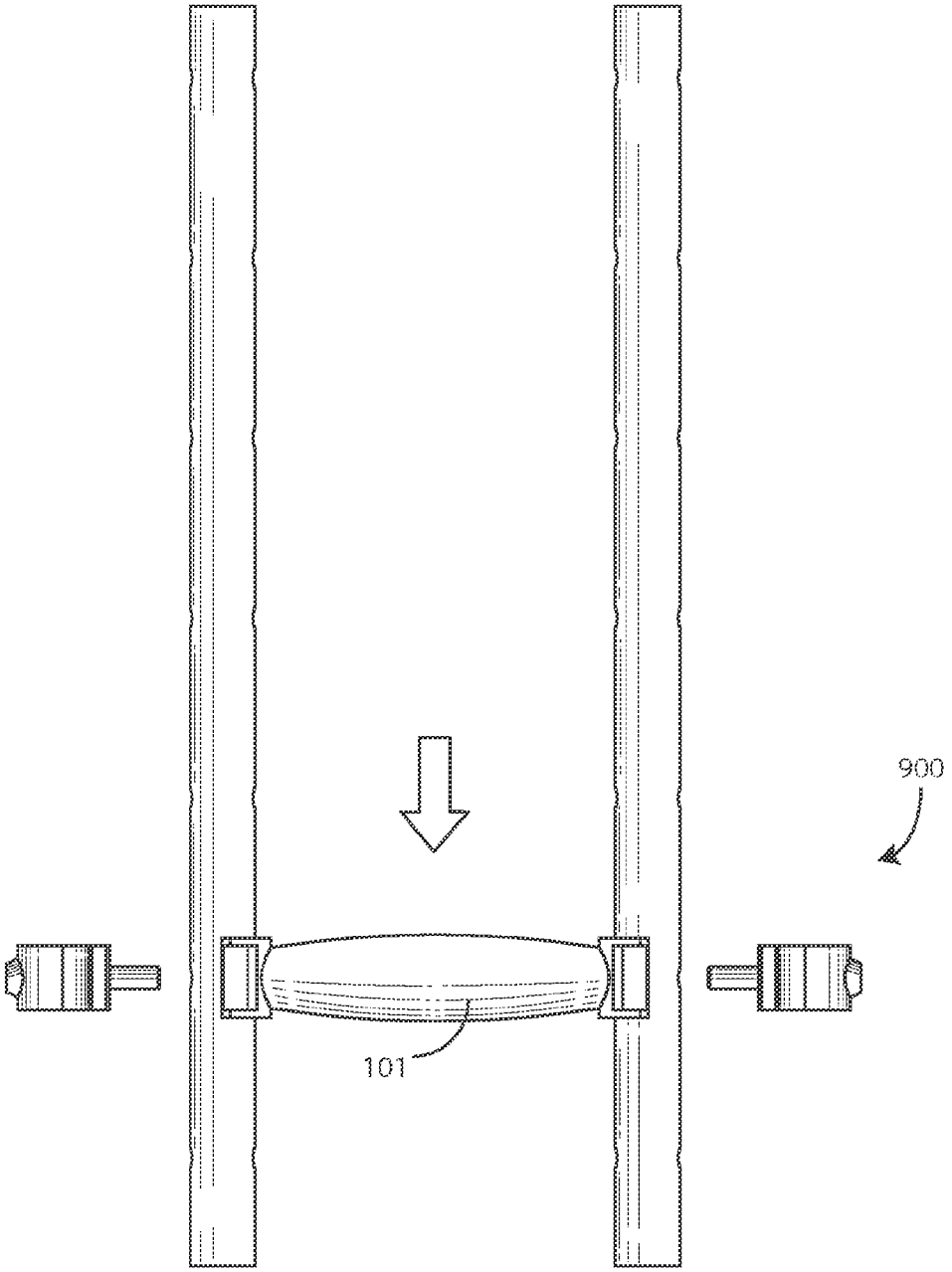
FIG. 13 illustrates yet another explanatory method step using a crutch grip in accordance with one or more embodiments of the disclosure.
Figure 14:
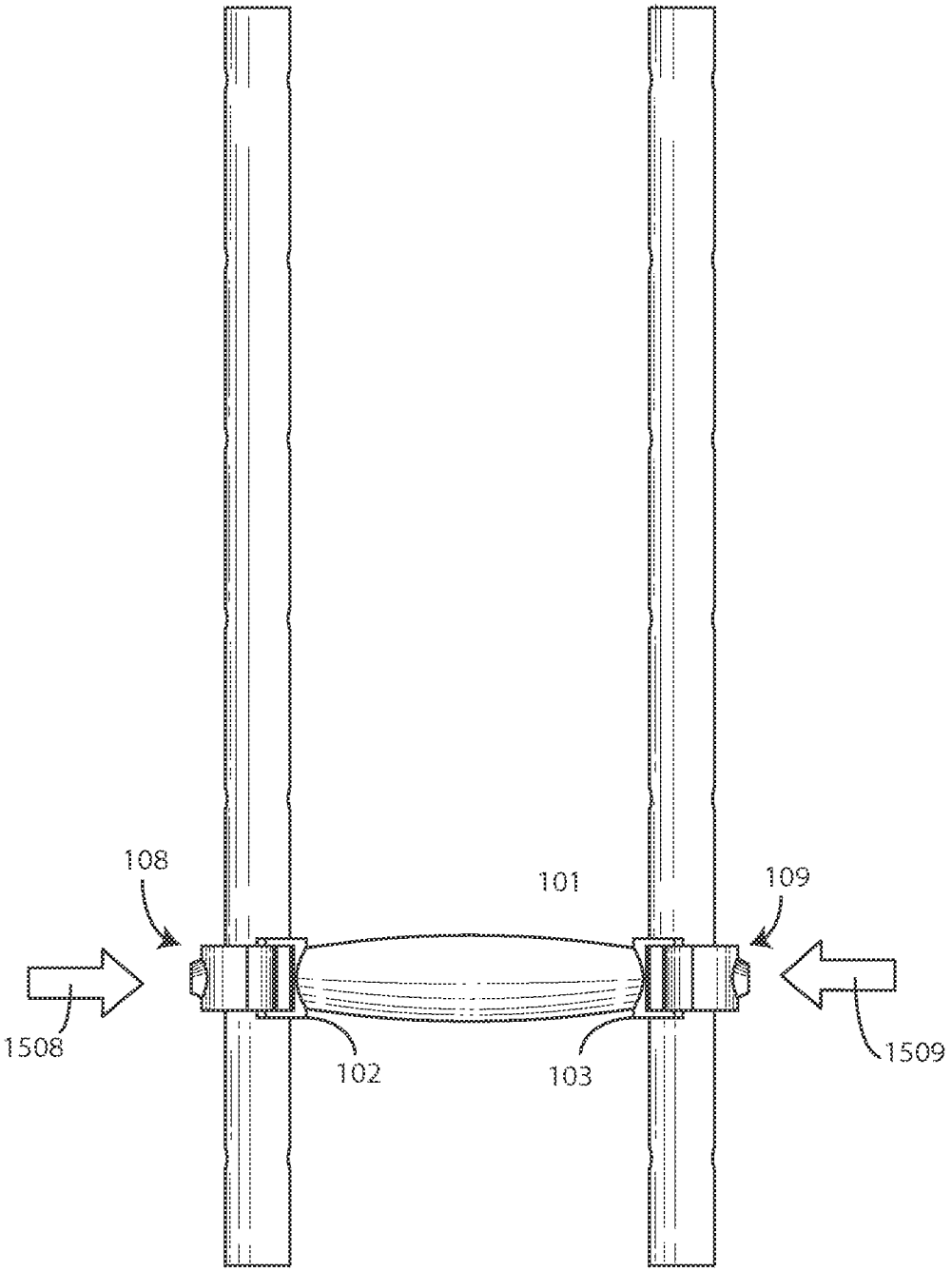
FIG. 14 illustrates another explanatory method step using a crutch grip in accordance with one or more embodiments of the disclosure.

As shown in FIG. 11, a user 1100 can then grasp 1101 the protruding grips 420,421 to deflect the pair of curved cantilevered legs 904 around the crutch post 106 to release the retaining clip 108 from the first grip end 102. The same can be done to remove the second retaining clip 109 from the second grip end 103, with the result shown in FIG. 12. As shown in FIG. 12, both retaining clips 108,109 have been detached from the first grip end 102 and the second grip end 103. Accordingly, the grip 101 can be adjusted 1200 to the desired height. The repositioned grip 101 is shown in FIG. 13. As shown in FIG. 14, the retaining clips 108,109 can then be reattached 1508,1509 to the first grip end 102 and the second grip end 103, respectively.

Figure 15:
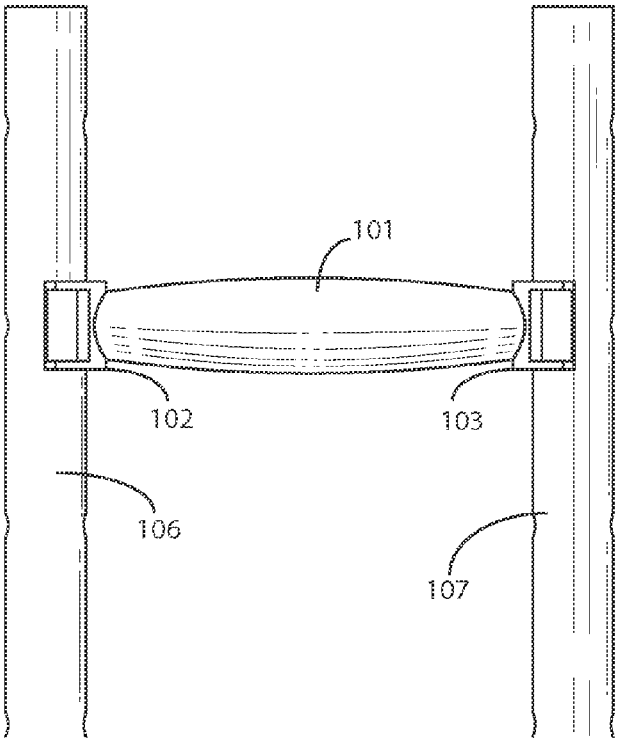
FIG. 15 illustrates another explanatory method step using a crutch grip in accordance with one or more embodiments of the disclosure.
Figure 16:
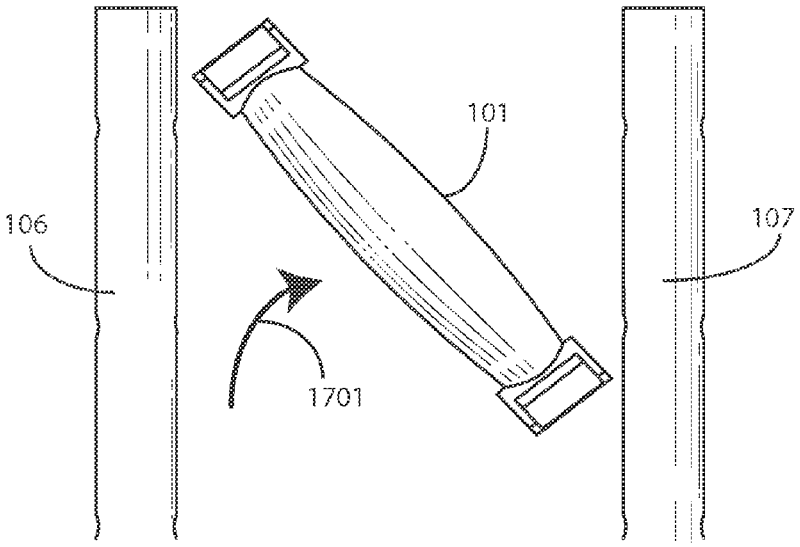
FIG. 16 illustrates another explanatory method step using a crutch grip in accordance with one or more embodiments of the disclosure.

When the grip 101 needs to be changed, due to it becoming soiled or for other reasons, it is very simple to do so using embodiments of the disclosure. The user simply needs to once again remove the retaining clips 108,109. The result is shown in FIG. 15. Since the grip 101 is pivotable between the two crutch posts 106,107 when the retaining clips (108,109) are detached from the first grip end 102 and the second grip end 103, it becomes easily removable from the crutch posts 106,107. As shown in FIG. 16, the grip 101 is simply pivoted 1701 between the crutch posts 106,107 and removed. The steps shown in FIGS. 7-10 can then be repeated to insert a new grip.

In the foregoing specification, specific embodiments of the present disclosure have been described. However, one of ordinary skill in the art appreciates that various modifications and changes can be made without departing from the scope of the present disclosure as set forth in the claims below. Thus, while preferred embodiments of the disclosure have been illustrated and described, it is clear that the disclosure is not so limited. Numerous modifications, changes, variations, substitutions, and equivalents will occur to those skilled in the art without departing from the spirit and scope of the present disclosure as defined by the following claims. For example, while numerous utilitarian features of crutch grips configured in accordance with one or more embodiments of the disclosure have been described above, each device has associated therewith a multitude of ornamental design features as well. To be sure, some of the elements associated with embodiments of the disclosure provide both functional and ornamental design features.

Accordingly, the specification and figures are to be regarded in an illustrative rather than a restrictive sense, and all such modifications are intended to be included within the scope of present disclosure. The benefits, advantages, solutions to problems, and any element(s) that may cause any benefit, advantage, or solution to occur or become more pronounced are not to be construed as a critical, required, or essential features or elements of any or all the claims.

What is claimed is:

1. A crutch grip, comprising:

a grip disposed between a first grip end and a second grip end, each of the first grip end and the second grip end defining a partially annular receiver for a crutch post; and at least one retaining clip, the at least one retaining clip comprising:

a base member;

a first, curved, cantilevered leg extending from a first side of the base member; and a second, curved, cantilevered leg extending from a second side of the base member;

the at least one retaining clip to removably engage an outer surface of at least one of the first grip end or the second grip end such that an annular clasp is defined between the at least one of the first grip end or the second grip end and the at least one retaining clip.

2. The crutch grip of claim 1, the base member, the first, curved, cantilevered leg, and the second, curved, cantilevered leg defining a partially closed C-shape about a central axis.

3. The crutch grip of claim 2, the base member comprising an arched base member.

4. The crutch grip of claim 2, the partially closed C-shape extending radially about the central axis at least 180 degrees.

5. The crutch grip of claim 2, one or more of the first, curved, cantilevered leg or the second, curved, cantilevered leg comprising a protruding finger grip defining a finger grasping surface that is concave relative to an opening of the partially closed C-shape.

6. The crutch grip of claim 2, further comprising a grip engagement post extending distally from the base member through the central axis and through an opening of the partially closed C-shape.

7. The crutch grip of claim 6, the at least one of the first grip end or the second grip end defining an aperture to receive the grip engagement post when the at least one retaining clip engages the outer surface of the at least one of the first grip end or the second grip end.

8. The crutch grip of claim 6, an interior surface of the partially closed C-shape defining a crutch post alignment recess disposed about the grip engagement post.

9. The crutch grip of claim 7, the at least one of the first grip end or the second grip end defining a crutch post alignment recess disposed about the aperture.

10. The crutch grip of claim 6, the base member, the first, curved, cantilevered leg, and the second, curved, cantilevered leg manufactured from a thermoplastic material, the grip engagement post manufactured from metal.

11. The crutch grip of claim 6, the at least one retaining clip comprising a protrusion disposed along an exterior of the partially closed C-shape opposite the grip engagement post.

12. The crutch grip of claim 2, the at least one of the first grip end or the second grip end comprising at least one detent disposed along the outer surface to receive an end of the first, curved, cantilevered leg, and the second, curved, cantilevered leg when the at least one retaining clip engages the outer surface of the at least one of the first grip end or the second grip end.

13. The crutch grip of claim 12, the grip and the at least one retaining clip having a common color.

14. The crutch grip of claim 13, the common color one of red or blue.

15. The crutch grip of claim 1, the partially annular receiver comprising a semi-circular receiver.

16. A crutch grip assembly, comprising:

a crutch comprising two crutch posts, each crutch post having a plurality of apertures defined therein; and a crutch grip, comprising:

a grip disposed between a first partially annular grip end and a second partially annular grip end; and at least one retaining clip comprising a pair of curved cantilevered legs extending from a base member to define a partially closed C-shape about a central axis;

the crutch grip disposed between the two crutch posts with the first partially annular grip end engaging a first crutch post and the second partially annular grip end engaging a second crutch post; and the at least one retaining clip removably engaging an outer surface of at least one of the first partially annular grip end or the second partially annular grip end to retain at least one of the first crutch post or the second crutch post between the at least one of the first partially annular grip end or the second partially annular grip end and the at least one retaining clip.

17. The crutch grip assembly of claim 16, the at least one retaining clip comprising a grip engagement post extending distally from the base member through the central axis and through an opening of the partially closed C-shape.

18. The crutch grip assembly of claim 17, the at least one of the first partially annular grip end or the second partially annular grip end defining an aperture to receive the grip engagement post.

19. The crutch grip assembly of claim 18, the grip engagement post passing through one aperture of the plurality of apertures and engaging the aperture of the at least one of the first partially annular grip end or the second partially annular grip end.

20. The crutch grip assembly of claim 19, the crutch grip pivotable between the two crutch posts when the at least one retaining clip is detached from the at least one of the first partially annular grip end or the second partially annular grip end.

* * * * *